US007930798B2

(12) United States Patent
Zhou et al.

(10) Patent No.: US 7,930,798 B2
(45) Date of Patent: Apr. 26, 2011

(54) STEAM CLEANING APPLIANCE

(75) Inventors: Hong Zhou, Zhongshan (CN); Maximilian Rosenzweig, Montreal (CA); Ognjen Vrdoljak, Laval (CA)

(73) Assignee: Euro-Pro Operating LLC, Newton, MA (US)

( * ) Notice: Subject to any disclaimer, the term of this patent is extended or adjusted under 35 U.S.C. 154(b) by 570 days.

(21) Appl. No.: 11/608,819

(22) Filed: Dec. 9, 2006

(65) Prior Publication Data

US 2007/0130719 A1 Jun. 14, 2007

(30) Foreign Application Priority Data

Dec. 10, 2005 (CN) ..... 2005 2 0120479 U

(51) Int. Cl.
*A47L 7/00* (2006.01)

(52) U.S. Cl. ..... 15/320; 15/403

(58) Field of Classification Search ..... 15/320–322, 15/403, 49.1, 97.1; *A47L 7/00*
See application file for complete search history.

(56) References Cited

U.S. PATENT DOCUMENTS

| | | | |
|---|---|---|---|
| 1,720,165 | A | 7/1929 | Bloom |
| 1,799,502 | A | 4/1931 | Colburn |
| 2,053,282 | A | 9/1936 | Gewalt |
| 2,962,975 | A | 12/1960 | Camp |
| 3,108,312 | A | 10/1963 | Ballantyne |
| 4,073,030 | A | 2/1978 | Albishausen |
| 4,074,387 | A | 2/1978 | Arato et al. |
| 4,327,459 | A | 5/1982 | Gilbert |
| 4,584,736 | A | 4/1986 | Gremminger |
| 4,905,712 | A | 3/1990 | Bowlin et al. |
| 4,910,895 | A | 3/1990 | Rethmeier et al. |
| 5,165,866 | A | 11/1992 | Kato |
| 5,988,920 | A | 11/1999 | Kunkler et al. |
| 6,289,551 | B1 | 9/2001 | Basile |

(Continued)

FOREIGN PATENT DOCUMENTS

CH 429 211 A 1/1967

(Continued)

OTHER PUBLICATIONS

Patent Abstracts of Japan, vol. 2002, No. 03, Apr. 3, 2002, Publication No. 2001327449 (Alpha Homes: KK), Nov. 21, 2001.

(Continued)

*Primary Examiner* — David A Redding
(74) *Attorney, Agent, or Firm* — Wolf, Greenfield & Sacks, P.C.

(57) ABSTRACT

The present invention discloses a steam floor mop, comprising a handle; a central body inside which a manual water pump, a water tank, and a steam generator are housed; and a floor brush connected flexibly to the central body, wherein the manual water pump, the water tank, and the steam generator are connected to the floor brush by means of pipes; said handle is connected directly to the piston rod of the manual water pump and serves to manipulate the operation of the manual water pump; said floor brush is covered by a cleaning cloth. In accordance with the steam floor mop of the present invention, by only pushing the handle of the steam floor mop, the steam can be generated and distributed to the floor brush so that the cleaning work having an effect of high temperature disinfecting and sterilization can be realized. It is not needed to power on the water pump additionally so as to supply water to the steam generator to generate the steam.

18 Claims, 4 Drawing Sheets

U.S. PATENT DOCUMENTS

| | | | | |
|---|---|---|---|---|
| 6,328,543 | B1 | 12/2001 | Benecke | |
| 6,490,753 | B1 * | 12/2002 | Chen | 15/320 |
| 6,571,421 | B1 * | 6/2003 | Sham et al. | 15/320 |
| 6,895,626 | B2 * | 5/2005 | Tsai | 15/98 |
| 7,225,503 | B1 * | 6/2007 | Lenkiewicz et al. | 15/320 |
| 7,266,292 | B1 | 9/2007 | Tsai | |
| 7,380,307 | B2 * | 6/2008 | Tsai | 15/320 |
| 7,458,128 | B2 * | 12/2008 | Smith et al. | 15/247 |
| 2002/0094285 | A1 | 7/2002 | Paolini et al. | |
| 2002/0106970 | A1 | 8/2002 | Falla | |
| 2002/0112744 | A1 | 8/2002 | Besseling | |
| 2003/0089383 | A1 | 5/2003 | Biggs | |
| 2004/0134016 | A1 | 7/2004 | Kisela | |
| 2006/0000049 | A1 | 1/2006 | Rosenzweig | |
| 2006/0000241 | A1 | 1/2006 | Rosenzweig | |
| 2007/0130719 | A1 | 6/2007 | Zhou | |
| 2008/0066789 | A1 | 3/2008 | Rosenzweig et al. | |
| 2008/0236635 | A1 | 10/2008 | Rosenzweig et al. | |
| 2009/0016916 | A1 | 1/2009 | Rosenzweig et al. | |

FOREIGN PATENT DOCUMENTS

| | | | |
|---|---|---|---|
| CN | 1368032 | A | 9/2002 |
| CN | 2540155 | Y | 3/2003 |
| CN | 2568117 | Y | 8/2003 |
| DE | 24 31 102 | A1 | 1/1976 |
| DE | 91 10 171 | U1 | 3/1993 |
| DE | 298 22 052 | U1 | 2/1999 |
| DE | 299 10 658 | U1 | 9/1999 |
| DE | 200 01 462 | U1 | 1/2001 |
| DE | 100 15 941 | A1 | 10/2001 |
| DE | 102 05 507 | A1 | 8/2003 |
| DE | 10205507 | A1 | 8/2003 |
| DE | 20 2006 001189 | U1 | 4/2006 |
| EP | 1 027 855 | A | 8/2000 |
| EP | 1 224 899 | A | 7/2002 |
| EP | 1 554 968 | A | 7/2005 |
| EP | 1 974 647 | A1 | 10/2008 |
| FR | 601 312 | A | 2/1926 |
| FR | 709 689 | A | 8/1931 |
| FR | 2 282 252 | A | 3/1976 |
| GB | 1 449 483 | | 8/1973 |
| GB | 2 294 196 | A | 4/1996 |
| GB | 2 416 526 | A | 2/2006 |
| JP | 2001327449 | A | 11/2001 |
| JP | 2004337454 | A | 12/2004 |
| RU | 2000475 | C1 | 9/1993 |
| RU | 2062356 | C1 | 6/1996 |
| SU | 866276 | A1 | 9/1981 |
| SU | 1379495 | A1 | 3/1988 |
| WO | WO 98/23385 | A | 6/1998 |
| WO | WO 99/26522 | A | 6/1999 |
| WO | WO 02/43550 | A | 6/2002 |
| WO | WO-2004/062457 | A2 | 7/2004 |
| WO | WO 2007/065371 | A | 6/2007 |
| WO | WO-2008/016741 | A2 | 2/2008 |
| WO | WO-2008/016761 | A2 | 2/2008 |

OTHER PUBLICATIONS

Euro-Pro Operating LLC; Steam Shark II Owner's Manual Model EP908EF; Nov. 2003; St. Laurent, Quebec H4S 1A7, pp. 1-39.

Euro-Pro Operating LLC; Portable Shark Steam Cleaner Owner's Manual Model SC505; Jan. 2003; p. 7; Champlain, NY 12919, pp. 1-11.

International Search Report and Written Opinion for PCT/US2007/069470 mailed Feb. 12, 2008.

International Preliminary Report on Patentability for PCT/US2007/069470 mailed Feb. 12, 2009.

International Search Report and Written Opinion for PCT/CN2006/003342 mailed Mar. 15, 2007.

International Preliminary Report on Patentability for PCT/CN2006/003342 mailed Jun. 11, 2008.

International Search Report and Written Opinion for PCT/US2007/072908 mailed Jan. 23, 2008.

International Preliminary Report on Patentability for PCT/US2007/072908 mailed Feb. 12, 2009.

Non Final Office Action for U.S. Appl. No. 11/496,143 mailed Dec. 30, 2008.

Final Office Action for U.S. Appl. No. 11/496,143 mailed Jul. 1, 2009.

Amendment to Accompany RCE for U.S. Appl. No. 11/496,143, filed Sep. 11, 2009.

Non Final Office Action for U.S. Appl. No. 11/496,143 mailed Oct. 16, 2009.

Non Final Office Action for U.S. Appl. No. 11/496,143 mailed Apr. 30, 2010.

Non Final Office Action for U.S. Appl. No. 11/769,521 mailed Sep. 18, 2008.

Final Office Action for U.S. Appl. No. 11/769,521 mailed May 15, 2009.

Amendment to Accompany RCE for U.S. Appl. No. 11/769,521, filed Sep. 11, 2009.

Non Final Office Action for U.S. Appl. No. 11/769,521 mailed Oct. 16, 2009.

Notice of Allowance for U.S. Appl. No. 11/769,521 mailed Jun. 15, 2010.

Non Final Office Action for U.S. Appl. No. 12/237,085 mailed Jun. 12, 2009.

Final Office Action for U.S. Appl. No. 12/237,085 mailed Mar. 2, 2010.

Office Action for CN Application No. 200680051301.0 mailed Jul. 12, 2010.

Non Final Office Action for U.S. Appl. No. 11/769,521 mailed Aug. 26, 2010.

Official Action for Russian Application No. 2008128011 issued Oct. 15, 2010.

* cited by examiner

STEAM CLEANING APPLIANCE

BACKGROUND OF THE INVENTION

1. Field of the Invention

This invention relates to a steam floor mop, and specifically, to a steam cleaning appliance for cleaning work.

2. Description of the Related Art

The current floor cleaning mops are generally classified into two types: one is the traditional floor mop, which can be used for the dry cleaning work, and is not suitable to realize a wet cleaning purpose; therefore, its application is limited; the other is the floor cleaning mop having a steam distributing function, with which the water is firstly heated vaporized to generate steam which is then distributed to the floor for the cleaning work so as to realize the effect of high-temperature disinfecting and sterilization. However, the current steam floor mop has the following drawbacks: when in use, the water needs to be loaded firstly to the steam generator by powering on the water pump additionally, and then is heated vaporized to generate steam for the cleaning work, this process takes such a long time that its application is inconvenient; in addition, the cleaning work has to be performed repeatedly many times in order to obtain a thorough cleaning effect, it is time-consuming and tiring. The main reasons for the above problems are: most of the cleaning surface of the current mop is flat, which is bad for the steam distributing to the whole cleaning surface, and thus results in the consequence that the cleaning surface can not be wetted uniformly, some portion of the cleaning surface is too dry while some portion is too wet, and that, the effect of high-temperature disinfecting and sterilization can not be realized; moreover, the cleaning cloth serves to cover the floor brush is too smooth without any pattern or stripe that the stains adhered to the floor cannot be cleaned easily.

SUMMARY OF THE INVENTION

In view of the above-described problems, it is an objective of the present invention to provide a steam floor mop with which the steam can be distributed instantaneously to the floor brush so as to perform the cleaning work by only pushing the handle of the steam floor mop.

It is another objective of the present invention to provide a steam floor mop with which the cleaning work can be performed conveniently and is time and labor saving, and the effect of high temperature disinfecting and sterilization can be realized thoroughly.

To achieve the above objectives, in accordance with one embodiment of the present invention, there is provided a steam floor mop comprising a handle; a central body inside which a manual water pump, a water tank, and a steam generator are housed; and a floor brush connected flexibly to the central body, wherein the manual water pump, the water tank, and the steam generator are connected to the floor brush by means of pipes; said handle is connected directly to the piston rod of the manual water pump and serves to manipulate the operation of the manual water pump; said floor brush is covered by a cleaning cloth.

In accordance with the steam floor mop of the present invention, wherein a buffer area is housed at the central steam inlet mouth of the floor brush, a plurality of rib stripes is extended from the center of the buffer area, a plurality of steam distributing grooves are formed between the rib stripes, a peripheral edge is set around the rim of the floor brush.

In accordance with the steam floor mop of the present invention, wherein said manual water pump comprises a pump body, a piston rod, a water inlet mouth, a water outlet mouth, a one-way inlet pump element, and a one-way outlet pump element, wherein the piston cavity of the pump body is a stepped cavity where the upper cavity has a larger diameter than the lower cavity.

In accordance with the steam floor mop of the present invention, wherein said steam generator comprises a conical shell and a heating element; a water inlet mouth is opened on the bottom end of the heating element, a plurality of electrical heating members is die cast and a handstand conical cavity is formed inside the heating element, a steam collection room is housed inside the conical shell and is positioned opposite to the conical cavity, a slideable steam separating cover is located between the steam collection room and the heating element, a steam collecting mouth for connecting the conical cavity to the steam collection room is opened at the central position of the steam separating cover, a steam exit is opened at the top end of the steam collection room, a plurality of C-shaped guide rings is set at the top of the water inlet mouth on the bottom surface of the heating element.

In accordance with the steam floor mop of the present invention, wherein said cleaning cloth is matchable with the floor brush and is served to cover tightly the floor brush, a plurality of #-shaped checks is formed on the surface of the cleaning cloth.

In accordance with the steam floor mop of the present invention, wherein the height of the peripheral edge of said floor brush is 0.5-2 mm higher than that of the rib stripes.

In accordance with the steam floor mop of the present invention, wherein said cleaning cloth is in the shape of vest, a pair of fixing straps are extended from the upper end of the cleaning cloth, a plurality of magic female tapes is affixed on the fixing straps, a plurality of magic male tapes that can be pasted fixed with the said magic female tapes is affixed on the lower portion of the cleaning cloth.

In accordance with the steam floor mop of the present invention, wherein a handle cover that can socket with the handle is located on the top end of said central body, the upper end of said handle cover is fixed on the central body.

In accordance with the steam floor mop of the present invention, wherein the one-way inlet pump element and the one-way outlet pump element of said water pump are in the shape of flat cone having a top structure that can be opened after an elastic deformation.

In accordance with the steam floor mop of the present invention, wherein a steam inlet mouth is also opened on said floor brush, and is connected to the water outlet mouth of the steam generator.

As a result, in accordance with the steam floor mop of the present invention, by only pushing the handle of the steam floor mop, the steam can be generated and distributed to the floor brush so that the cleaning work having an effect of high temperature disinfecting and sterilization can be realized. It is not needed to power on the water pump additionally so as to supply water to the steam generator to generate the steam. Besides, a plurality of rib stripes are set on the floor brush, and a plurality of steam distributing grooves are formed between the rib stripes, so that the steam can be distributed uniformly to the whole cleaning surface of the floor brush. In addition, the floor brush is covered tightly by a cleaning cloth having a plurality of #-shaped checks formed thereon, so that the stains adhered to the floor can be cleaned easily. Therefore, by utilizing the steam floor mop of the present invention, the cleaning work can be performed conveniently and is time and labor saving, the effect of high temperature disinfecting and sterilization can be realized thoroughly.

BRIEF DISCRIPTION OF THE DRAWINGS

Figure 1:
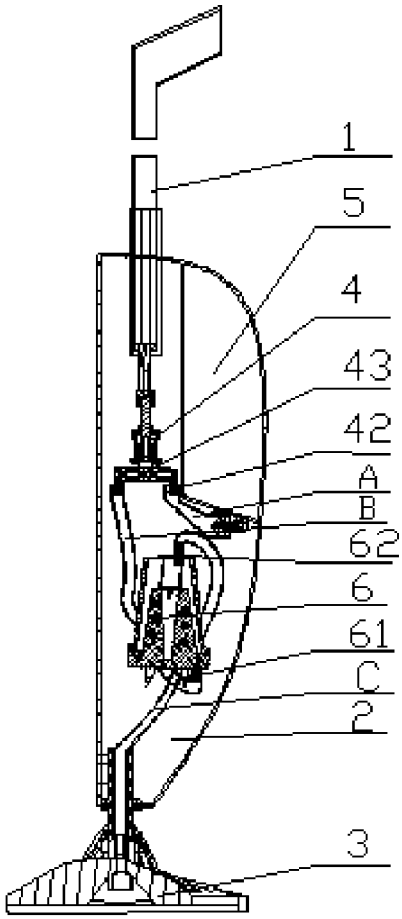
FIG. 1 is a structural view of a steam floor mop of the present invention.

The reference numbers of the various parts shown in the drawings are listed below, in which handle corresponds to the number 1; handle cover—11; central body—2; floor brush—3; steam inlet mouth—33; buffer area—34; rib strip—35; steam distributing groove—36; peripheral edge—37; manual water pump—4; piston rod—41; water inlet mouth of water pump—42; water outlet mouth of water pump—43; one-way inlet pump element—44; one-way outlet pump element—45; piston cavity—46; pump body—47; water tank—5; steam generator—6; water inlet mouth—61; steam exit—62; conical shell—63; heating element—64; electrical heating member—65; conical cavity—66; steam collection room—67; steam separating cover—68; steam collecting mouth—69; C-shaped guide ring—641; cleaning cloth—7; fixing strap—71; magic female tape—72; magic male tape—73; first pipe—A; second pipe—B; and third pipe—C.

DETAILED DESCRIPTION OF THE INVENTION

Figure 2:
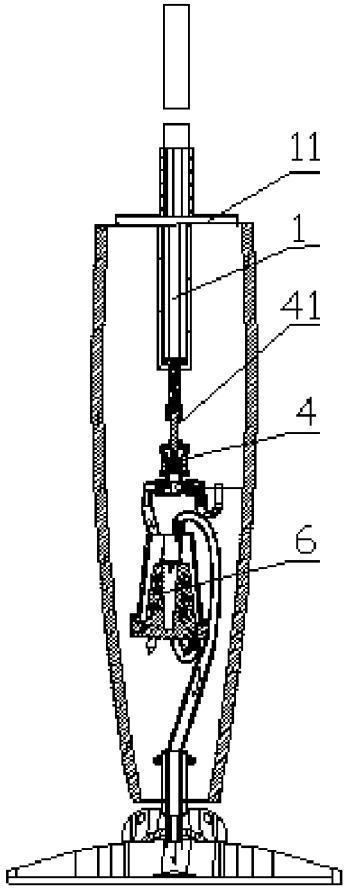
FIG. 2 is a sectional view of a steam floor mop of the present invention.
Figure 3:
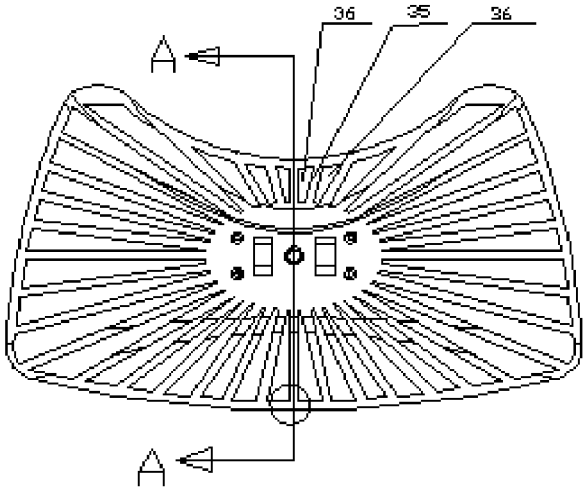
FIG. 3 is a top view of a floor brush for a steam floor mop of the present invention.
Figure 4:
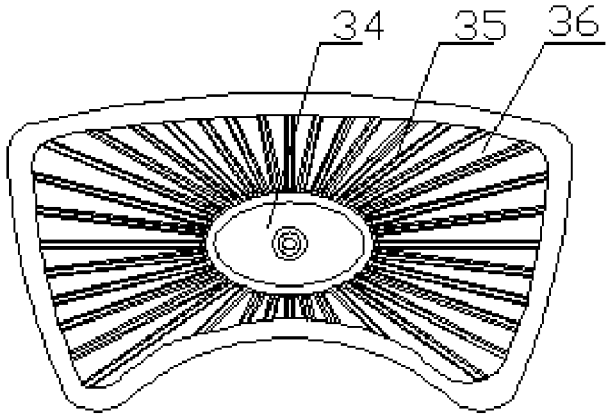
FIG. 4 is a bottom view of a floor brush for a steam floor mop of the present invention.
Figure 5:
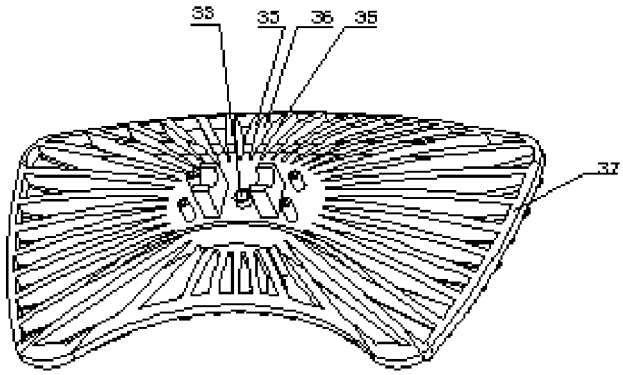
FIG. 5 is a perspective view of a floor brush for a steam floor mop of the present invention.
Figure 6:
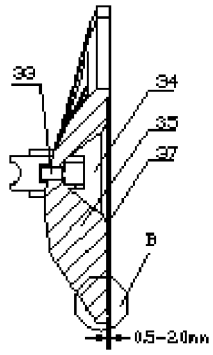
FIG. 6 is an A-A sectional view of FIG. 3 of the present invention.
Figure 7:
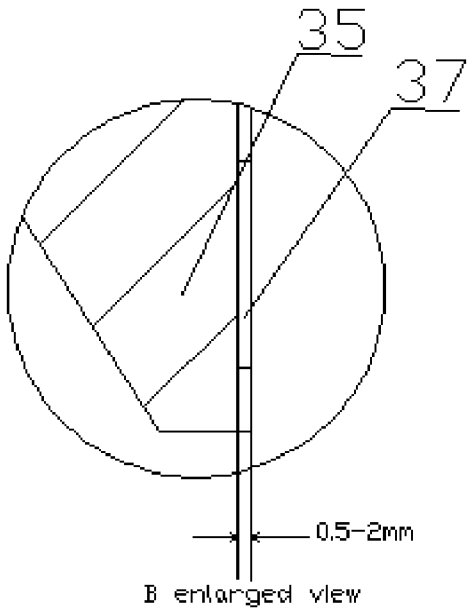
FIG. 7 is an enlarged view of portion B of FIG. 6 of the present invention.

As shown in FIGS. 1-2, a steam floor mop comprises a handle 1, a central body 2 inside which a manual water pump 4, a water tank 5, and a steam generator 6 are housed; and a floor brush 3 connected flexibly to the bottom end of the central body 1, wherein said handle 1 is connected directly to the piston rod 41 of the manual water pump 4, and serves to manipulate the operation of the manual water pump 4; said floor brush 3 is covered with a cleaning cloth 7. A water inlet mouth 42 and a water outlet mouth 43 are formed at the lower end of said manual water pump 4, wherein said water inlet mouth 42 is connected to the water tank 5 by means of a first pipe A; said water outlet mouth 43 is connected to the water inlet mouth 61 of the steam generator 6 by means of a second pipe B; the steam exit 62 of the steam generator 6 is connected to the floor brush 3 by means of a third pipe C.

A handle cover 11 that can socket with the handle 1 and serves to limit the moving range of the handle 1 is also located on the top end of the central body 2, the upper end of the handle cover 11 is fixed on the central body 1.

As shown in FIGS. 3-7, the floor brush 3 of the present invention is a fan-shaped brush, a steam inlet mouth 33 is further opened at the central position of the floor brush 3, and is connected to the water outlet mouth 62 of the steam generator 6 by means of a third pipe C. A buffer area 34 is housed around the steam inlet mouth 33 of the floor brush and serves mainly to buffer the pressure and speed of the steam in order to guide smoothly the flow of the steam. A plurality of rib strips 35 is extended from the center of the buffer area 34 and a plurality of steam distributing grooves 36 is formed between the rib strips. In this way, the steam can be distributed uniformly to the whole cleaning surface of the floor brush, the excessive steam can be vented off, and thus the excessive moisture of the cleaning cloth 7 can be avoided. Besides, a peripheral edge is set around the rim of the floor brush 3, and is 0.5-2 mm higher than the rib strips 35.

Figure 9:
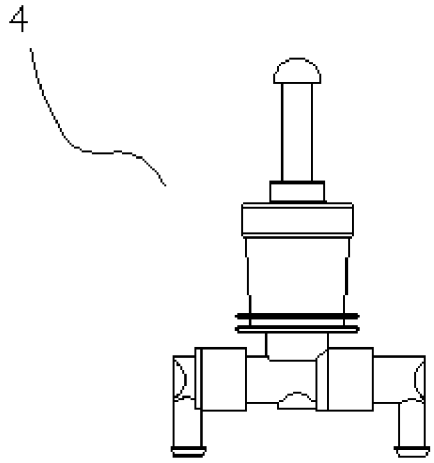
FIG. 9 is a perspective view of a water pump for a steam floor mop of the present invention.
Figure 10:
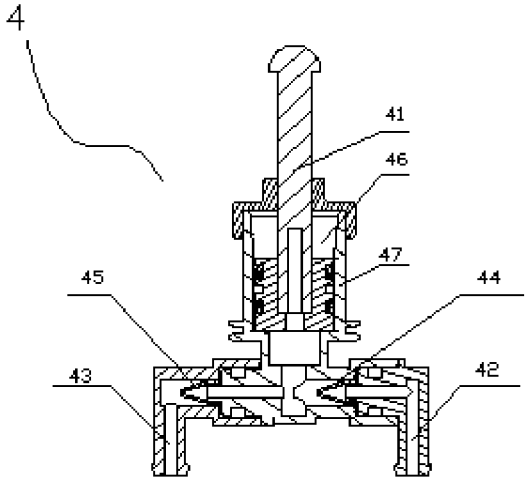
FIG. 10 is a sectional view of FIG. 9 of the present invention.

As shown in FIGS. 9-10, a manual water pump 4 comprises a pump body 41, a piston rod 41, a water inlet mouth 42, a water outlet mouth 43, a one-way inlet pump element 44, and a one-way outlet pump element 45. Wherein the piston cavity 46 of said pump body 47 is a stepped cavity where the upper cavity has a larger diameter than the lower cavity. The one-way inlet and outlet pump elements 44, 45 are made of elastomer material and have a top structure that can be opened after an elastic deformation so as to form a two-layered pressure against apparatus, and thereby to against the backpressure of the steam generator 6, and thus to prevent the pump elements from being broken down, as well as to control the one-way flow of the water. Namely, the manual water pump 4 can be regarded as a one-way automatic artificial intelligent feed pump, by pushing the handle 1 of the steam floor mop, the piston rod 41 of the manual water pump 4 can be operated to push automatically against the pump water so as to supply the water to the steam generator 6.

Figure 11:
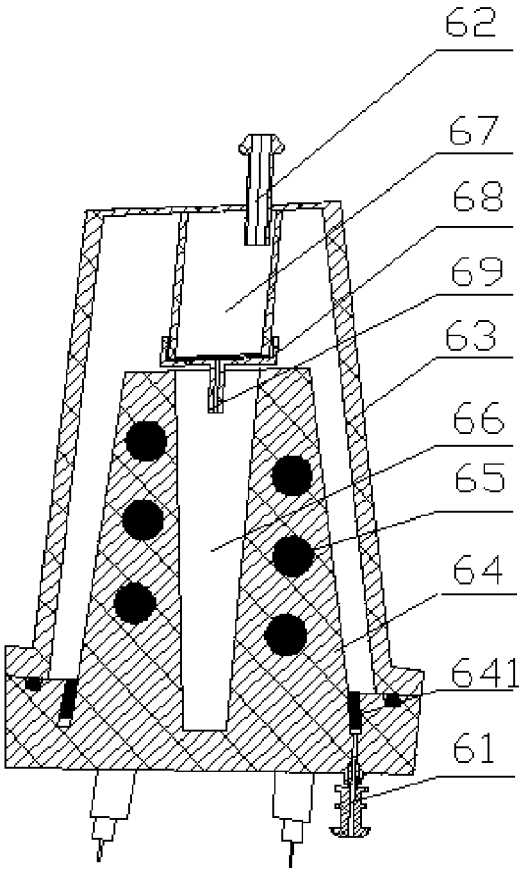
FIG. 11 is a structural view of a steam generator for a steam floor mop of the present invention.

As shown in FIG. 11, the steam generator 6 comprises a conical shell 63 and a heating element 64, wherein a water inlet mouth 61 is formed at the bottom end of the heating element 64, and a plurality of electrical heating members 65 is die cast and a handstand conical cavity 66 is formed inside the heating element 64; a steam collection room 67 is housed inside the conical shell 63 and is positioned opposite to the conical cavity 66, a slideable steam separating cover 68 is located between the steam collection room 67 and the heating element 64, a steam collecting mouth 69 for connecting the conical cavity 66 to the steam collection room 67 is opened at the central position of the steam separating cover 68, a steam exit 62 is opened on the top end of said steam collection room. In addition, a plurality of C-shaped guide rings is set at the top of the water inlet mouth on the bottom end of the heating element 64, and is served to separate the flow of the water in order to distribute the water uniformly to the whole surface of the heating element.

Figure 8:
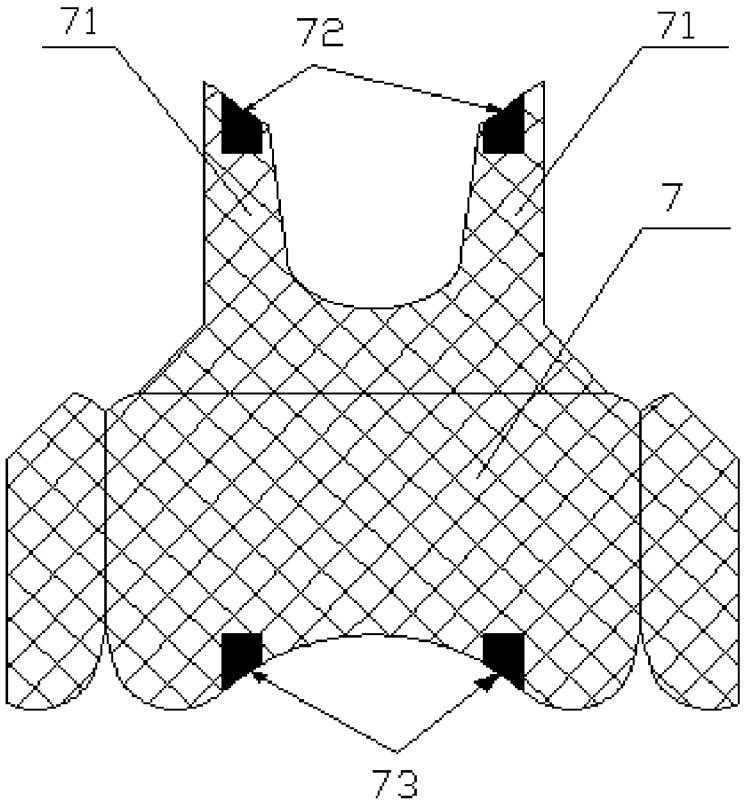
FIG. 8 is a planar view of a cleaning cloth for a steam floor mop of the present invention.

As shown in FIG. 8, the cleaning cloth 7 is in the shape of vest, a pair of fixing straps 71 is extended from the upper end of the cleaning cloth 7; a magic female tape 72 is affixed on each of said fixing straps, a pair of magic male tapes 73 that can be pasted fixed with the magic female tapes 72 are affixed on the lower end of the cleaning cloth 7. The size of the cleaning cloth 7 that is matchable with the size of the floor brush is applied to cover the floor brush 3 tightly. A plurality of #-shaped checks are formed on the surface of the cleaning cloth so that the stains adhered on the floor can be cleaned easily. The cleaning cloth 7 covered on the upper portion of the floor brush 3 is applied to encase the excessive steam, while that covered on the lower portion of the floor brush 3 is used for cleaning the floor.

As a result, by using the steam floor mop of the present invention, a cleaning work can be performed conveniently and is time and labor saving, the effect of high temperature disinfecting and sterilization can be realized.

What is claimed is:

1. A steam appliance, comprising:

a handle;

a central body including: a manual water pump having a pump cavity, a piston in the cavity and a piston rod connected to the piston; a water tank; and a steam generator having a steam outlet; and a steam mop head connected flexibly to the central body; wherein the manual water pump, the water tank, and the steam generator are connected by pipes;

said handle is constructed and arranged to be grippable by a user's hand to move the steam mop head, and is operatively connected to the piston rod of the manual water pump and serves to manipulate the operation of the manual water pump in response to a pushing force on the handle towards the central body;

said steam mop head has a steam inlet that is connected to the steam outlet of the steam generator; and said steam mop head is adapted to be covered by a cleaning cloth.

2. The steam floor mop according to claim 1, wherein the steam mop head includes:

a depression in the central region of the mop head to form a buffer area where the steam inlet is fed to the steam mop head, the steam mop head defining a peripheral edge;

a plurality of rib strips extending from the buffer area to the peripheral edge of the mop head; and a plurality of steam distributing grooves which are formed between the rib strips.

3. The steam appliance according to claim 2, wherein the height of the peripheral edge of said steam mop head is from 0.5 to 2 mm higher than that of the rib strips.

4. The steam appliance according to claim 2, wherein said steam generator comprises a conical shell and a heating element;

a water inlet mouth is opened on the bottom end of the heating element;

a plurality of electrical heating members are die cast and a handstand conical cavity is formed inside the heating element;

a steam collection room is housed inside the conical shell and is positioned opposite to the conical cavity;

a slideable steam separating cover is located between the steam collection room and the heating element;

a steam collecting mouth for connecting the conical cavity to the steam collection room is opened at the central position of the steam separating cover;

a steam exit is opened at the top end of the steam collection room; and a plurality of C-shaped guide rings is set at the top of the water inlet mouth on the bottom surface of the heating element.

5. The steam appliance according to claim 1, wherein said manual water pump comprises a pump body, a water inlet mouth, a water outlet mouth, a one-way inlet pump element, and a one-way outlet pump element, and the pump cavity of the pump body is a stepped cavity where the upper cavity has a larger diameter than the lower cavity.

6. The steam appliance according to claim 5, wherein the one-way inlet pump element and the one-way outlet pump element of said water pump are in the shape of a flat cone having a top structure that can be opened after an elastic deformation.

7. The steam appliance according to claim 1, wherein said steam generator comprises a conical shell and a heating element;

a water inlet mouth is opened on the bottom end of the heating element;

a plurality of electrical heating members is die cast and a handstand conical cavity is formed inside the heating element;

a steam collection room is housed inside the conical shell and is positioned opposite to the conical cavity;

a slideable steam separating cover is located between the steam collection room and the heating element;

a steam collecting mouth for connecting the conical cavity to the steam collection room is opened at the central position of the steam separating cover;

the steam outlet is opened at the top end of the steam collection room; and a plurality of C-shaped guide rings is set at the top of the water inlet mouth on the bottom surface of the heating element.

8. The steam appliance according to claim 1, further comprising a cleaning cloth having a size which is matchable with the steam mop head and is configured to tightly cover the floor steam mop head, wherein the cleaning cloth includes a grid pattern formed on the surface of the cleaning cloth.

9. The steam appliance according to claim 1, wherein said manual water pump comprises a pump body, a water inlet mouth, a water outlet mouth, a one-way inlet pump element, and a one-way outlet pump element, and the pump cavity of the pump body is a stepped cavity where the upper cavity has a larger diameter than the lower cavity.

10. The steam appliance according to claim 1, wherein the steam mop head includes:

a depression in the central region of the mop head to form a buffer area where the steam inlet is fed to the steam mop head, the steam mop head having a peripheral edge;

a plurality of rib strips extending from the buffer area to the peripheral edge of the steam mop head; and a plurality of steam distributing grooves are formed between the rib strips with the height of the peripheral edge of said steam mop head from 0.5 to 2 mm higher than that of the rib strips.

11. The steam appliance according to claim 1, wherein the handle is connected directly to the piston rod.

12. The steam appliance according to claim 1, wherein said handle is configured to manipulate the operation of the manual water pump to push against water to supply water to the steam generator in response to movement of the handle towards the central body.

13. A steam appliance, comprising:

a handle;

a central body including: a manual water pump having a pump cavity, a piston in the cavity and a piston rod connected to the piston; a water tank; and a steam generator;

a steam mop head connected flexibly to the central body;

the manual water pump, the water tank, and the steam generator connected to the steam mop head by means of pipes;

said handle is constructed and arranged to be grippable by a user's hand to move the steam mop head, and is operatively connected to the piston rod of the manual water pump and serves to manipulate the operation of the manual water pump in response to a pushing force on the handle towards the central body;

said steam mop head adapted to be covered by a cleaning cloth; and a handle cover that is configured and dimensioned to receive the handle is located on the top end of said central body; and the upper end of said handle cover is fixed on the central body.

14. The steam appliance according to claim 13, wherein said cleaning cloth has a size which is matchable with the steam mop head and is configured to tightly cover the steam mop head, and wherein the cleaning cloth includes a grid pattern that is formed on the surface of the cleaning cloth.

15. The steam appliance according to claim 13, wherein a steam inlet is opened on said steam mop head and is connected to the steam generator.

16. The steam appliance according to claim 13, wherein said manual water pump comprises a pump body, a water inlet mouth, a water outlet mouth, a one-way inlet pump element, and a one-way outlet pump element, and the pump cavity of the pump body is a stepped cavity where the upper cavity has a larger diameter than the lower cavity.

17. The steam appliance according to claim 16, wherein the one-way inlet pump element and the one-way outlet pump element of said water pump are in the shape of a flat cone having a top structure that can be opened after an elastic deformation.

18. A steam appliance, comprising:

a handle;

a central body configured and dimensioned to house a manual water pump, a water tank and a steam generator, the manual water pump having a pump body, a pump cavity, a piston in the cavity, a piston rod connected to the piston, a water inlet, a water outlet, a one-way inlet pump element and a one-way outlet pump element;

a steam mop head connected to the central body;

the manual water pump, the water tank, and the steam generator are connected to the steam mop head of pipes;

said handle is constructed and arranged to be grippable by a user's hand to move the steam mop head, and is operatively connected to the piston rod of the manual water pump and serves to manipulate the operation of the manual water pump in response to a pushing force on the handle towards the central body;

the one-way inlet pump and the one-way outlet pump are formed of elastomeric material to control one-way flow of water; and said steam mop head has a depression for receiving a pipe from the steam generator for distribution of steam to a cleaning cloth.

* * * * *